US007632123B2

(12) United States Patent
Nakagawa

(10) Patent No.: US 7,632,123 B2
(45) Date of Patent: Dec. 15, 2009

(54) SURFACE MOUNT CONNECTOR HAVING HOUSING WITH GROOVE

(75) Inventor: Tsuyoshi Nakagawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/222,351

(22) Filed: Aug. 7, 2008

(65) Prior Publication Data

US 2009/0042427 A1 Feb. 12, 2009

(30) Foreign Application Priority Data

Aug. 9, 2007 (JP) ..... 2007-208136

(51) Int. Cl.
*H01R 29/00* (2006.01)

(52) U.S. Cl. ..... 439/188; 439/63; 439/944

(58) Field of Classification Search ..... 439/188, 439/63, 581, 944
See application file for complete search history.

(56) References Cited

U.S. PATENT DOCUMENTS 6,068,492 A * 5/2000 Uratani et al. ..... 439/63
6,554,630 B2 * 4/2003 Uratani ..... 439/188
6,585,532 B2 * 7/2003 Uratani et al. ..... 439/188
6,761,571 B2 * 7/2004 Hida ..... 439/188
7,217,137 B1 * 5/2007 Nakagawa ..... 439/63
2006/0128195 A1 * 6/2006 Chen ..... 439/188

FOREIGN PATENT DOCUMENTS

JP 61-157273 U 9/1986
JP 2001-176612 6/2001
JP 2007-141665 A 6/2007

* cited by examiner

*Primary Examiner*—Hae Moon Hyeon
(74) *Attorney, Agent, or Firm*—Kubotera & Associates, LLC

(57) ABSTRACT

A surface mount connector includes a housing and a movable terminal attached to the housing. The movable terminal includes a movable section to be movable relative to the housing, an adhering section connected to the movable section and having an adhering surface relative to the housing, and a connecting section connected to the adhering section via a joining section. The adhering surface includes a groove extending toward the movable section having a first width. The movable terminal further includes an opening portion connected to the groove. The opening portion extends in a first direction crossing a second direction that the adhering section is connected to the movable section and having a second width larger than the first width.

18 Claims, 6 Drawing Sheets

SURFACE MOUNT CONNECTOR HAVING HOUSING WITH GROOVE

CROSS-REFERENCES TO RELATED APPLICATIONS

The disclosure of Japanese Patent Application No. 2007-208136, filed on Aug. 9, 2007, is incorporated in the application by reference.

BACKGROUND OF THE INVENTION AND RELATED ART STATEMENT

The present invention relates to a surface mount connector. In particular, the present invention relates to a surface mount connector capable of suitably doing with flux when the surface mount connector is attached to a circuit board with solder.

A conventional apparatus such as a cellar phone includes a coaxial connector with a switch. A coaxial connector with a switch can inspect circuit characteristics of a device by switching a signal path in the device with the switch.

Patent Reference has disclosed an example of the conventional coaxial connector of this type. The coaxial connector disclosed therein is mounted on an inner circuit board of a device with solder through a reflow treatment. In the process of soldering, flux contained in cream solder may enter the coaxial connecter upon soldering through a capillary phenomenon in some cases. In order to prevent flux from entering, the conventional coaxial connector has a groove in a direction orthogonal to a direction that flux enters, thereby preventing flux from entering and a contact failure of a terminal of the coaxial connector.

Patent Reference: Japanese Patent Publication No. 2001-176612

In the conventional coaxial connector described above, the groove is provided in a housing in the direction orthogonal to the direction that flux enters. Accordingly, it is difficult to completely guide flux into the groove, thereby making it difficult to fully prevent flux from entering into an inappropriate section such as a contact section. In addition, the groove has a size large enough so as not to cause a capillary phenomenon. Accordingly, it is difficult to securely hold flux.

In view of the problems described above, an object of the present invention is to provide a surface mount connector capable of solving the problems of the conventional connector. In the surface mount connector, it is possible to properly guide flux, thereby securely preventing flux from entering an undesired portion. Further, it is possible to hold flux upon generation thereof, thereby securely preventing flux from entering.

In the specification, flux is not limited to flux itself, and may include a substance such as a mixture of flux and solder that may enter upon soldering and cause contact failure.

Further objects and advantages of the invention will be apparent from the following description of the invention.

SUMMARY OF THE INVENTION

In order to attain the objects described above, according to the present invention, a surface mount connector includes a housing and a movable terminal attached to the housing. The movable terminal includes a movable section to be movable relative to the housing; an adhering section connected to the movable section for forming an adhering surface relative to the housing; and a connecting section connected to the adhering section via a joining section and to be connected with soldering.

The adhering surface has a groove extending toward the movable section. The movable terminal has an opening portion connected to the groove provided in a crossing direction crossing a direction that the adhering section is connected to the movable section and having a width larger than that of the groove.

In the surface mount connector of the invention, the opening portion may extend toward the movable section in the direction that the adhering section is connected to the movable section.

In the surface mount connector of the invention, the groove may have a width on a side of the joining section in the crossing direction larger than that of the joining section near the groove.

In the surface mount connector of the invention, the opening portion may be provided at one of a rear end of the groove and a middle portion of the groove.

In the surface mount connector of the invention, a plurality of the grooves may be provided and connected to each other via the opening portion. It may be possible to reduce a depth of the grooves, thereby reducing the number of the grooves.

In the surface mount connector of the invention, a space may be provided above the opening portion provided in the movable terminal.

The surface mount connector of the invention may be a coaxial connector with a switch. The surface mount connector may include a stationary terminal secured in the housing and the movable terminal paired with the stationary terminal.

According to the invention, the groove securely guides flux generated due to reflow upon soldering, so that it is possible to prevent flux from entering beyond a specified position.

DESCRIPTION OF THE PREFERRED EMBODIMENTS

Hereunder, embodiments of the present invention will be described referring to the accompanying drawings.

Figure 1:
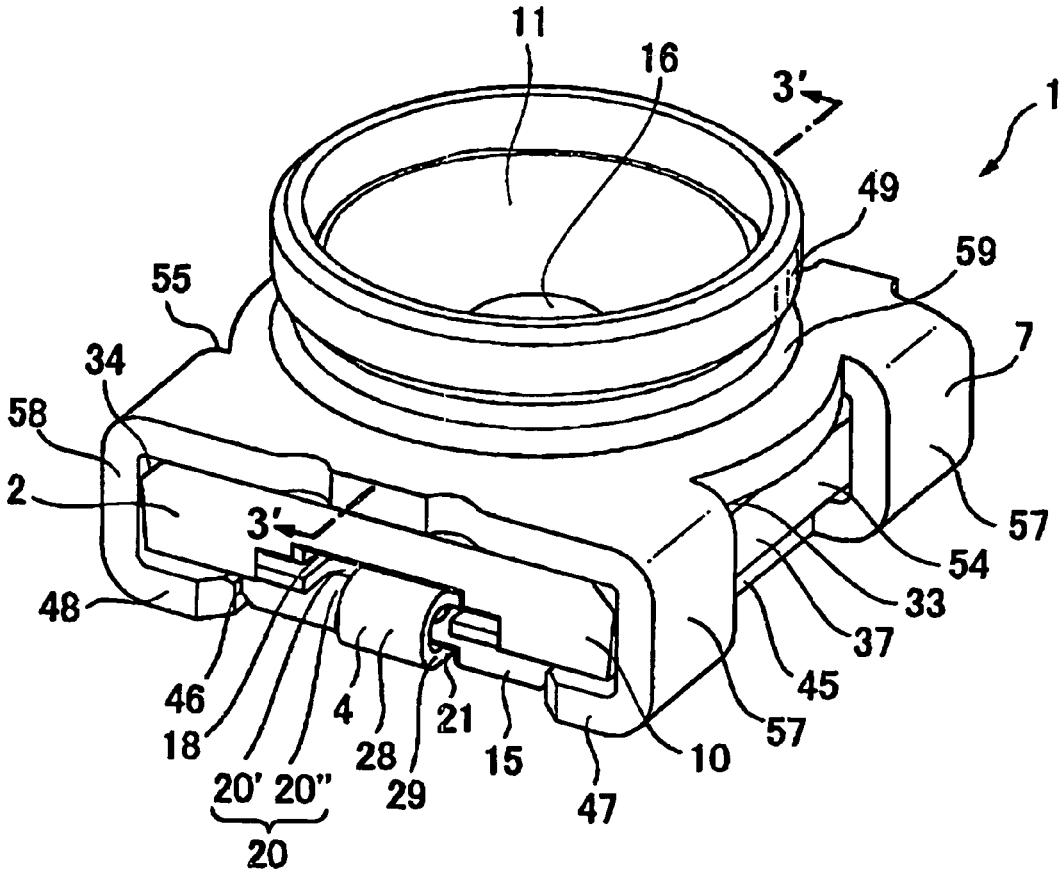
FIG. 1 is a perspective view showing a surface mount connector according to an embodiment of the present invention.
Figure 2:
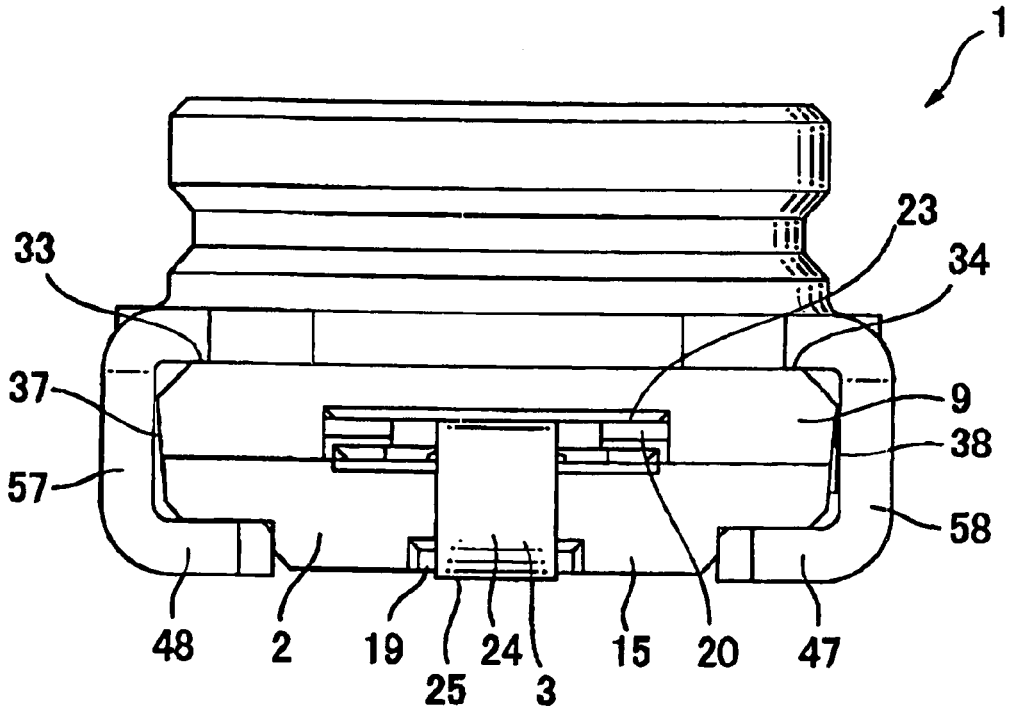
FIG. 2 is a backside view showing the surface mount connector according to the embodiment of the present invention.
Figure 3:
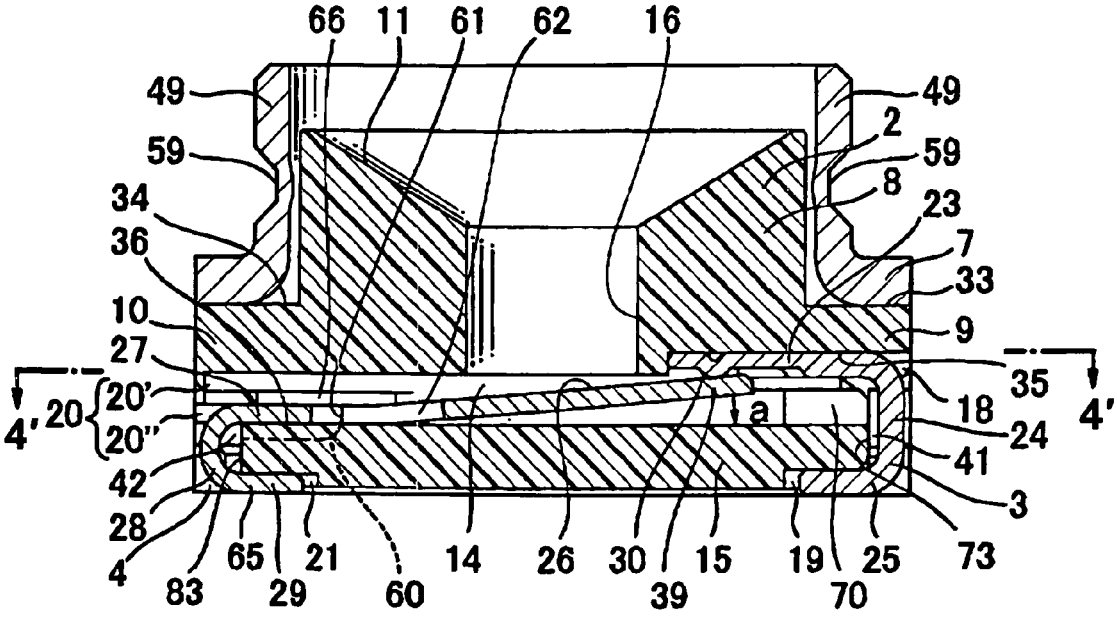
FIG. 3 is a sectional view of the surface mount connector according to the embodiment of the present invention taken along a line 3'3' (a centerline) in FIG. 1.

FIG. 1 is a perspective view of a coaxial connector 1 or a surface mount connector with a switch according to an embodiment of the invention. FIG. 2 is a backside view of the coaxial connector with a switch. FIG. 3 is a sectional view of the coaxial connector with a switch according to the embodiment of the present invention taken along a line 3'-3' (a centerline) in FIG. 1.

Figure 4:
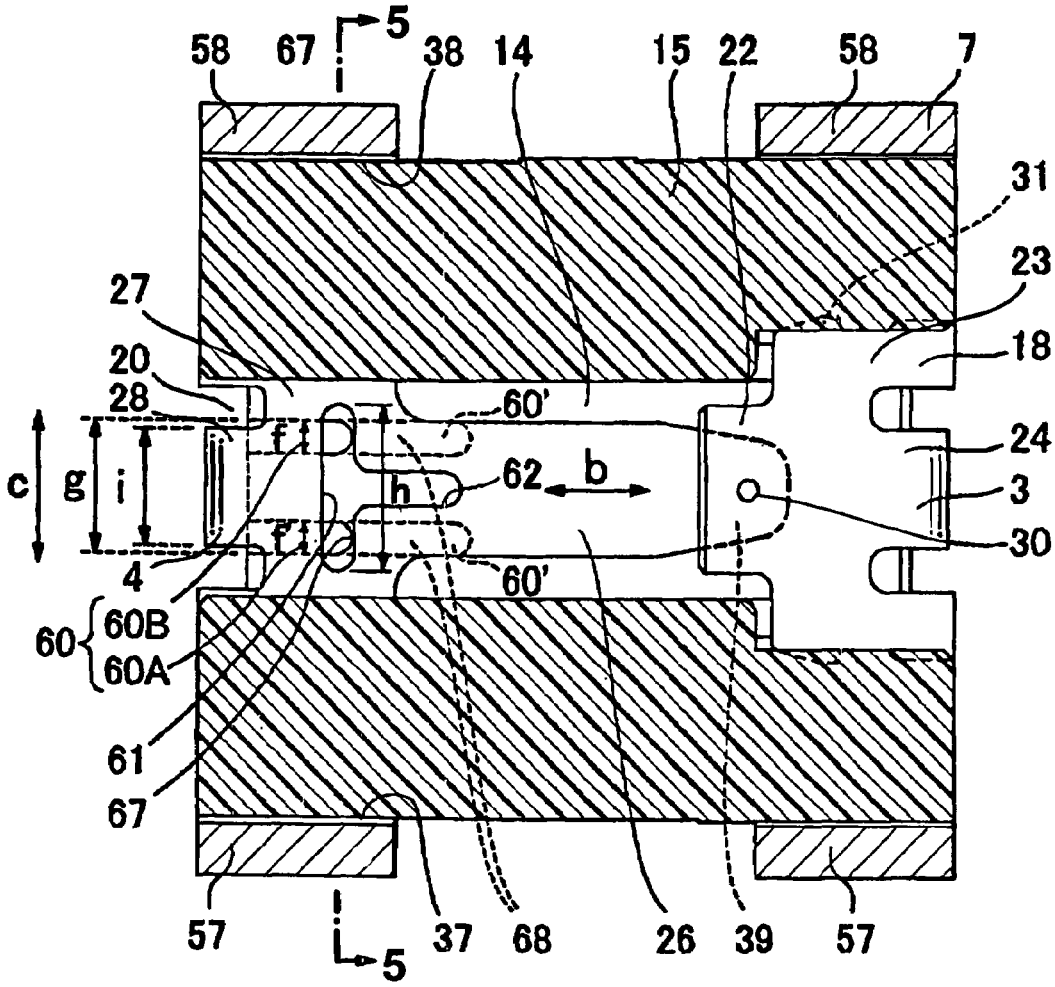
FIG. 4 is a sectional view of the surface mount connector according to the embodiment of the present invention taken along a line 4'-4' (an upper portion) in FIG. 3.
Figure 5:
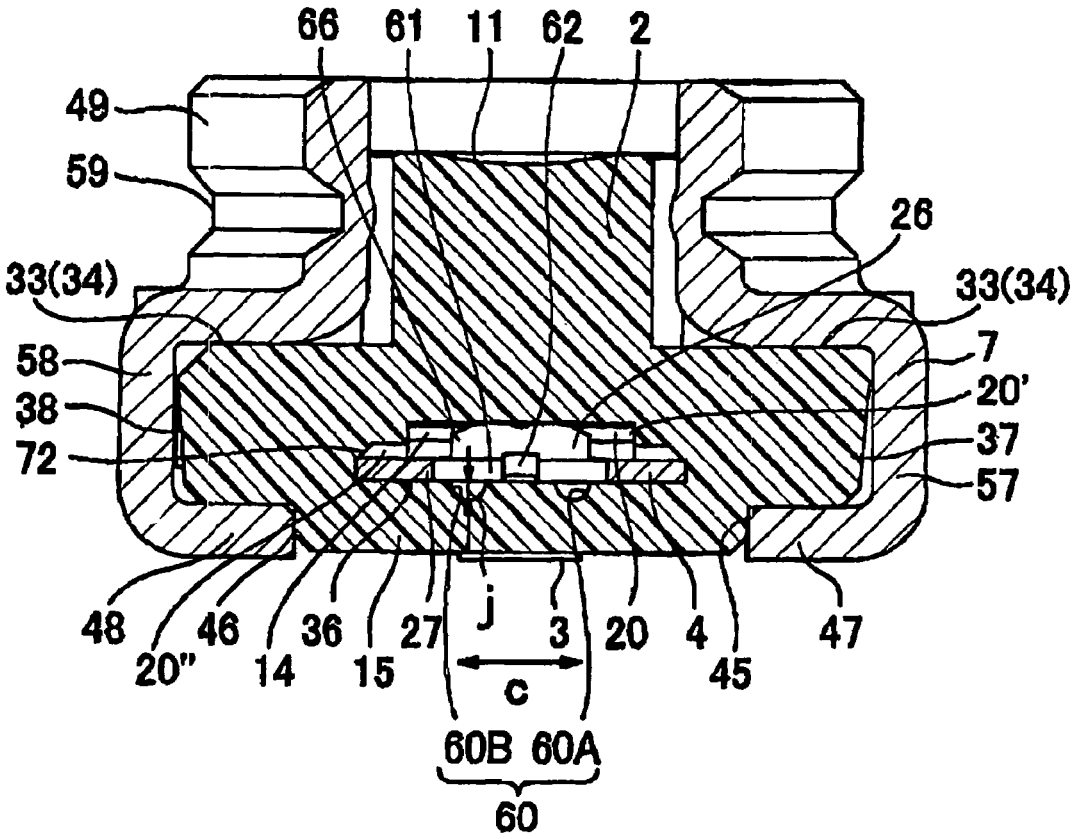
FIG. 5 is a sectional view of the surface mount connector according to the embodiment of the present invention taken along a line 5-5 in FIG. 4.

FIG. 4 is a sectional view of the coaxial connector with a switch according to the embodiment of the present invention taken along a line 4'-4' (an upper portion) in FIG. 3. FIG. 5 is a sectional view of the coaxial connector with a switch according to the embodiment of the present invention taken along a line 5-5 in FIG. 4.

FIG. 4 is a sectional view of the coaxial connector with a switch according to the embodiment of the present invention taken along a line 4-4 (an upper portion) in FIG. 3. FIG. 5 is a sectional view of the coaxial connector with a switch according to the embodiment of the present invention taken along a line 5-5 in FIG. 4.

In the embodiment, the coaxial connector 1 with a switch includes an insulating housing 2 made of a resin; a set of a stationary terminal 3 and a movable terminal 4 attached to the housing 2; and an outer conductor 7 made of a metal to cover the housing 2 from outside. The coaxial connector 1 is used for inspecting circuit characteristics of an electronic device such as a cellular phone by switching a signal path in the electronic device using a terminal switch formed of the stationary terminal 3 and the movable terminal 4.

In an actual use, the coaxial connector 1 is mounted on a board (not illustrated) in the electronic device by soldering. When the coaxial connector 1 is used for inspection, an inspection needle (not illustrated) is inserted from thereabove, and the stationary terminal 3 and the movable terminal 4 are switched between a contacted state and a non-contacted state.

In the embodiment, the insulating housing 2 includes a substantially circular cylindrical main body 8; a relatively thin protruding section 9 and a relatively thick protruding section 10, which respectively protrude outward under the main body 8; and a bottom plate 15. In order to easily insert the inspection needle, the main body 8 may have an inverted conical recess 11 at a center part of an upper surface thereof.

In the embodiment, a hollow section 14 is formed between the thin protruding section 9 and the thick protruding section 10, and the bottom plate 15. A connecting hole 16 is provided along the axial direction between the recess 11 and the hallow section 14. The hallow section 14 is provided so as to connect to outside through a lateral hole 18 for inserting the stationary terminal 3 provided in the protruding section 9 and a lateral hole 20 for inserting the movable terminal 4 provided in the protruding section 10.

Further, a lower groove 19 that extends parallel to the lateral hole 18 and has a narrower width than that of the lateral hole 18 is formed in a side face of the bottom plate 15 on a side of the protruding section 9. A lower groove 21 that extends parallel to the lateral hole 20 and has a narrower width is provided in a side face of the bottom plate on a side of the protruding section 10.

As shown in FIG. 3, the stationary terminal 3 has a securing section 23, a joining section 24, and a connecting section 25 in this order while being formed continuously to each other. The securing section 23 is a wide flat section extending in the horizontal direction, and has a slightly narrower end 22. The securing section 23 is pressed into the lateral hole 18 using the press-in protrusion 31 (refer to FIG. 4) while having a relatively large space underneath, and adheres to a bottom face of the protruding section 9.

In the embodiment, the joining section 24 is a curved section having a smaller width than that of the securing section 23 for joining the securing section 23 and the connecting section 25, and is provided while having a space against a side face of the bottom plate 15. The connecting section 25 is a flat section that extends horizontally in the same direction and has the same width as that of the joining section 24. The connecting section 25 is provided on the bottom plate 15 while being received in the lower groove 19. In an actual use, the connecting section 25 is secured on a specified circuit (not illustrated) by soldering.

In the embodiment, the movable terminal 4 includes a movable section 26; securing sections (adhering sections) 27; a joining section 28; and a connecting section 29 in this order while being formed continuously to each other. The movable section 26 is a narrower flat section that is slightly biased upward, and has a slightly sharp end 39. The movable section 26 can move relative to the insulating housing 2 and the stationary terminal 3.

Upon insertion into the lateral hole 20, the movable section 26 is inserted in the lateral hole 20, more specifically, in a narrow upper hole 20' thereof. Upon insertion in the upper hole 20', the sharp end 39 of the movable section 26 elastically contacts with the lower contact point 30 provided on the securing section 23 of the stationary terminal 3.

When the sharp end 39 is displaced downward (in an arrow direction a in FIG. 3) while contacting with the inspection needle, the sharp end 39 disconnects from the stationary terminal 3 and turns to, i.e., is switched to, the non-contacted state.

In the embodiment, the securing section 27 is a wide flat section that extends horizontally, and is pressed in the lateral hole 20, more specifically, a wide lower hole 20" thereof, using the protrusion 32 (refer to FIG. 6) and a sloped surface 72 (refer to FIG. 5) formed so as to protrude more downward at a back part of the lateral hole 20. Accordingly, the stationary section 27 is pressed and secured therein such that the securing section 27 adheres to the upper face 36 of the bottom plate 15 on the protruding section 10 side and to a flat surface.

In the embodiment, the joining section 28 is a curved section having a smaller width than that of the movable terminal 26 for joining between the securing section 27 and the connecting section 29. The joining section 28 is attached while having a relatively large space 42 against the side face 83 of the bottom plate 15. The connecting section 29 is a flat section that extends horizontally in the same direction as that of the securing section 27 and has the same width as that of the joining section 28. The connecting section 29 is attached onto the bottom plate 15 while being received in the lower groove 21. In an actual use, the connecting section 29 is connected to a specific circuit (not illustrated) on a board by soldering.

In the embodiment, the outer conductor 7 is formed of a sheet metal. The outer conductor 7 essentially includes a circumferential wall 49 and legs 57 and 58 having the same shape. The circumferential wall 49 is a cylindrical section that covers the main body 8 of the insulating housing 2 from the outside. In order to maintain the contact with the inspection needle, the circumferential wall may have an annular grove 59 therearound. The legs 57 partially cover the upper sections 33 and 34 of the protruding sections 9 and 10 and a side face 37 of the insulating housing 2, and are bent to fit step-like section 45 at the end section 47 and secured thereon. The legs 57 are formed being cut at a center part thereof so as to be divided.

Similarly to the legs 57, the legs 58 partially cover the upper sections 33 and 34 of the protruding sections 9 and 10 and side face 37 of the insulating housing 2, and are bent to fit the step-like section 45 at the end section 47 and secured thereon. The outer conductor 7 is connected to a ground circuit on the board (not illustrated) by soldering at the bottom face of the end sections 47 and 48.

Referring to FIGS. 3 and 4, a capillary phenomenon will be described. When the connecting section 29 of the movable terminal 4 is soldered on the electrical board, liquefied flux may flow toward the movable section 26 through a capillary phenomenon. Through the capillary phenomenon, the liquefied flux crawls up toward the movable section 26 through a section 65 having a U character shape (refer to FIG. 3), which is formed of an adhering surface formed between the connecting section 29 and a surface of the lower groove 21, a space 42 between the joining section 28 and the side face 83 of the bottom plate 15, and an adhering surface formed between the securing section 27 and an upper face 36 of the bottom plate 15.

When the flux reaches the movable section 26, the movable section 26 may have a problem in spring characteristics. Further, an electrical contact between the movable section 26 and the stationary terminal 3 may be failed. Accordingly, it is necessary to prevent the flux from reaching the movable section 26 through the capillary phenomenon.

While the problems due to the capillary phenomenon may be related to the movable terminal 4, there is no such problem related to the stationary terminal 3. This is because, even when the flux crawls up through the space 41, the flux would not reach the securing section 23 due to the space 70 under the securing section 23.

In order to solve the problem related to the flux crawling up through the capillary phenomenon, the housing 2 has grooves 60 to guide the flux toward the movable section 26 through the capillary phenomenon. Each of the grooves 60 extends along an adhering surface between the securing section 27 and the upper surface 36 of the bottom plate 15 in a direction connecting the securing section 27 and the movable section 26 (in an arrow direction b in FIG. 4).

Figure 6:
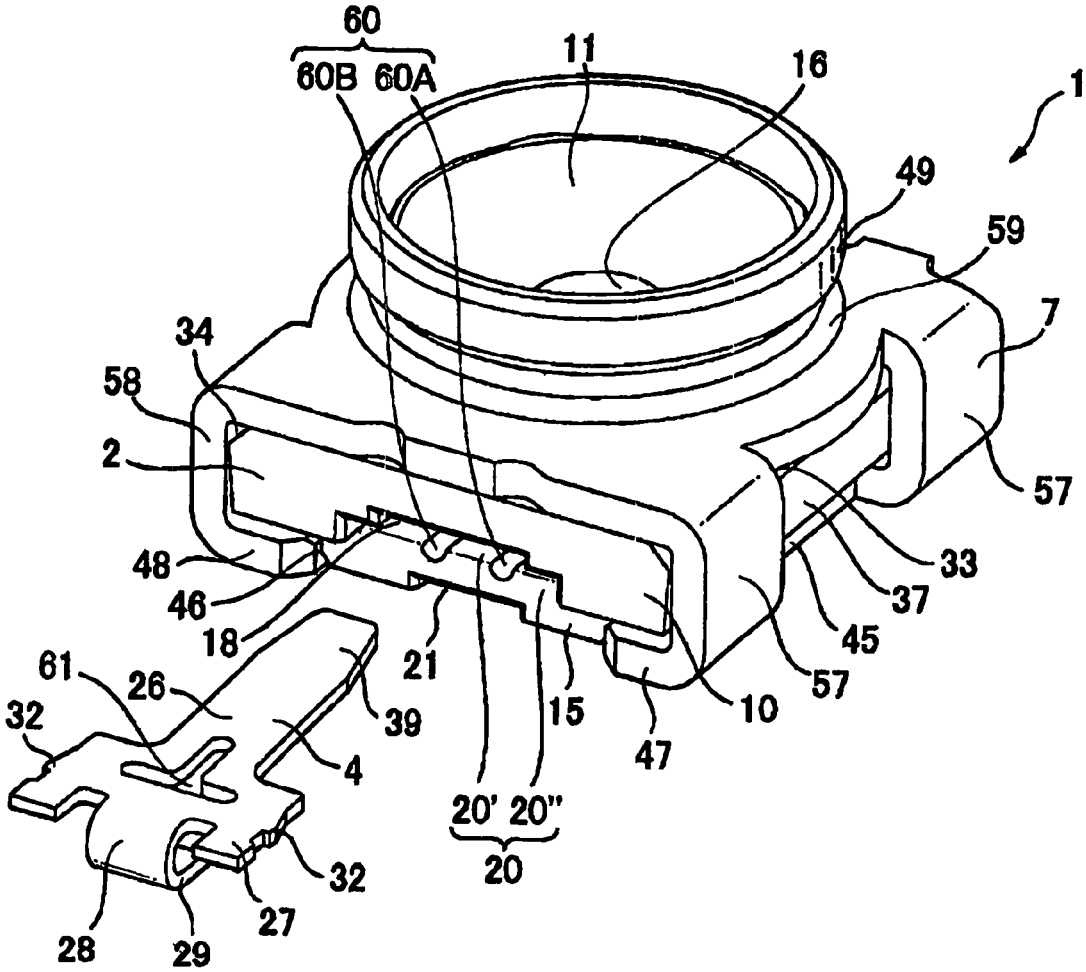
FIG. 6 is a perspective view showing the surface mount connector in a state before a movable terminal is inserted according to the embodiment of the present invention.

In the embodiment, the housing 2 has two grooves 60A and 60B having the same shape and size. The grooves 60A and 60B are also fully illustrated in FIG. 6. FIG. 6 is a perspective view showing the surface mount connector or the coaxial connector 1 in a state before the movable terminal 4 is inserted according to the embodiment of the present invention.

In the embodiment, the flux can be guided (controlled) toward the movable section 26 along the grooves 60. Accordingly, it is possible to prevent the flux from flowing through the capillary phenomenon along the adhering surface between the securing section 27 and the upper face 36 of the bottom plate 15 except the grooves 60. Further, when the lateral hole 20 is formed in the insulating housing 2, a rod-like section having a semicircular section corresponding to a sectional shape of the grooves 60 is disposed in a mold (not illustrated), thereby making it possible to easily form the grooves 60. The rod-like section may be also useful for increasing the strength of the mold.

In the embodiment, the movable terminal 4 has a hole 61 being connected to the grooves 60 along a direction (an arrow direction c in FIG. 4) intersecting the arrow direction b that the grooves 60 extend. The hole 61 has a width h in the arrow direction c larger than respective widths f of the groove 60A and the groove 60B, or larger than a total width g of the groove 60A and the groove 60B on a side of the joining section 28 of the movable terminal 4. The total width g of the groove 60A and the groove 60B on the side of the joining section 28 of the movable terminal 4 is slightly larger than the width i of the joining section 28 of the movable terminal 4 near the grooves 60A and 6GB. By setting the widths in this way, it is possible to securely guide the flux flowing through the capillary phenomenon.

In the embodiment, the hole 61 is provided at the respective rear end positions of the grooves 60A and 60B while joining the grooves 60A and 60B to each other. It is not necessary to provide the holes 61 at the rear end positions. For example, grooves 60' shown with a hidden line may be provided. In the grooves 60', a length thereof in the direction b increases, and the hole 61 is provided in the middle of the grooves 60'.

Further, it is not necessary to provide the hole 61 so as to join the grooves 60A and 60B to each other, and the hole 61 can be independently provided in the grooves 60A and 60B. With the hole 61, the groove 60 is opened, so that it is possible to stop the flux and securely hold the flux or solder in the hole 61 when an amount of the flux, the solder, etc. is too large.

In the embodiment, the hole 61 may have an extended section 62 with a T character shape relative to the groove 60, and the extended section 62 extends toward the movable section 26. With the extended section 62, it is possible to increase a volume of the opened portion of the groove 60 and also to improve the spring characteristics of the movable terminal 4.

Furthermore, with the extended section 62, the plate width is changed, so that a stress applied on the movable terminal 4 near a boundary between the movable section 26 and the securing section 27 is dispersed, thereby reducing stress concentration.

As shown in FIGS. 4 and 5, both sides of the extended section 62, i.e., near regions 68 connecting the securing section 27 and the movable section 26, have curved ends. With this configuration, it is possible to increase the strength of the movable terminal 4.

Furthermore, a space 66 (refer to FIGS. 3 and 5) necessary to displace the movable section 26 is provided above the hole 61. Accordingly, the groove 60 can be fully opened while connecting with the space 66 at the hole 61. Even when the hole 61 is filled with the flux, it is possible to divert the flux to the upper space 66, thereby securely preventing contact failure.

In the embodiment described above, the coaxial connector with a switch is explained as an example. In addition to the coaxial connector, the present invention can be widely applied to various types of connectors having movable terminals. Therefore, the invention shall not be limited to the application in the coaxial connector with a switch.

In the embodiment described above, the movable terminal 4 has the grooves 60, and the housing 2 may have similar groove. Two grooves 60 are provided, and the number of the grooves 60 can be adjusted as far as the grooves 60 have enough capacity to guide the flux. For example, when the depth of the groove 60 (the width j shown in FIG. 5) decreases and the width of the groove 60 in the arrow direction c increases, it is possible to maintain the capacity of the groove 60 necessary for the flux, thereby decreasing the number of the grooves 60.

While the invention has been explained with reference to the specific embodiments of the invention, the explanation is illustrative and the invention is limited only by the appended claims.

What is claimed is:

1. A surface mount connector comprising:

a housing including a groove having a first width; and a movable terminal attached to the housing, said movable terminal including a movable section to be movable relative to the housing, an adhering section connected to the movable section and having an adhering surface facing the groove, and a connecting section connected to the adhering section via a joining section, said movable terminal further including an opening portion connected to the groove, said opening portion having a second width larger than the first width.

2. The surface mount connector according to claim 1, wherein said opening portion extends toward the movable section.

3. The surface mount connector according to claim 1, wherein said joining section has a third width smaller than the first width.

4. The surface mount connector according to claim 1, wherein said opening portion is provided at a rear end of the groove.

5. The surface mount connector according to claim 1, wherein said opening portion is provided at a middle portion of the groove.

6. The surface mount connector according to claim 1, wherein said housing includes a plurality of grooves.

7. The surface mount connector according to claim 6, wherein said grooves are connected to each other via the opening portion.

8. The surface mount connector according to claim 1, wherein said housing includes a space above the opening portion.

9. The surface mount connector according to claim 1, further comprising a stationary terminal secured in the housing.

10. A surface mount connector comprising:

a housing including a groove having a first width; and a movable terminal attached to the housing, said movable terminal including a movable section to be movable relative to the housing, an adhering section connected to the movable section and having an adhering surface relative to the housing, and a connecting section connected to the adhering section via a joining section, said movable section including an opening portion connected to the groove, said opening portion having a second width larger than the first width.

11. The surface mount connector according to claim 10, wherein said opening portion extends toward the movable section.

12. The surface mount connector according to claim 10, wherein said joining section has a third width smaller than the first width.

13. The surface mount connector according to claim 10, wherein said opening portion is provided at a rear end of the groove.

14. The surface mount connector according to claim 10, wherein said opening portion is provided at a middle portion of the groove.

15. The surface mount connector according to claim 10, wherein said housing includes a plurality of grooves.

16. The surface mount connector according to claim 15, wherein said grooves are connected to each other via the opening portion.

17. The surface mount connector according to claim 10, wherein said housing includes a space above the opening portion.

18. The surface mount connector according to claim 10, further comprising a stationary terminal secured in the housing.

* * * * *